United States Patent [19]

Coffman et al.

[11] Patent Number: 4,509,275

[45] Date of Patent: Apr. 9, 1985

[54] DRYER HAVING TOP PIVOT FOR TUMBLER

[75] Inventors: Randall R. Coffman, McHenry; James E. Mitchell, Algonquin, both of Ill.

[73] Assignee: Norman Dryer Company, Inc., Crystal Lake, Ill.

[21] Appl. No.: 542,524

[22] Filed: Oct. 17, 1983

[51] Int. Cl.[3] ..... F26B 11/02

[52] U.S. Cl. ..... 34/126; 34/56; 34/133; 34/236

[58] Field of Search ..... 34/56, 126, 133, 236, 34/239

[56] References Cited

U.S. PATENT DOCUMENTS

| | | | |
|---|---|---|---|
| 2,067,543 | 1/1937 | Purkett | 34/126 |
| 2,253,047 | 8/1941 | Purkett | 34/126 |
| 2,768,451 | 10/1956 | Purkett | 34/126 |
| 2,852,236 | 9/1958 | Jackson | 34/133 |
| 2,906,035 | 9/1959 | DeMoss | 34/56 |
| 3,064,361 | 11/1962 | Turner | 34/133 |
| 3,121,621 | 2/1964 | Jackson | 34/126 |
| 3,861,865 | 1/1975 | Grantham | 34/133 |
| 4,015,930 | 4/1977 | Grantham | 34/133 |

*Primary Examiner*—Edward G. Favors
*Assistant Examiner*—Steven E. Warner
*Attorney, Agent, or Firm*—Lee, Smith & Zickert

[57] ABSTRACT

A dryer for extracting moisture from wet goods, such as linens, of the type having a tumbler cylinder, an open side of the cylinder through which goods are inserted and removed, and a shell in which the cylinder is housed. The dryer has an external support frame including a portion extending above the shell. The shell is hingedly supported at its top to the support frame and is pivotable about the hinge to permit goods to be removed from the cylinder directly beneath the shell. A door is included for closing the open side of the tumbler cylinder and has a lower door segment which is fixed to the support frame and an upper door segment which is attached to the shell for shifting across the face of the shell to open and close an upper portion thereof.

15 Claims, 8 Drawing Figures

54
24
56
24
10
20
82
12
60
46
42
18
58
14
44
16
34
30
36
40
32
26
4
4
86
36
26
62
18
18
66
68
20
80
70
78
80
12
22
64

10
20
24
56
54
24
60
58
46
42
44
18
34
62
40
36
40
26
86
32
14
62
70
18
66
5.
68
80
80
78
12
5.
86
22
64

DRYER HAVING TOP PIVOT FOR TUMBLER

BACKGROUND OF THE INVENTION

This invention relates to dryers for extracting moisture from wet goods, such as linens, and in particular to a dryer having a housing shell for the tumbler thereof which is pivotally supported at its top so that the contents of the tumbler can be expelled directly beneath the shell.

Dryers of the nature of the present invention are typically utilized in commercial laundering facilities where large quantities of wet linens are dried in batches of up to several hundred pounds. Typically, wet linens are delivered to the dryer in large "cakes" on an appropriate conveyor, such as that set forth in our copending U.S. patent Ser. No. 540,436 filed Oct. 11, 1983 entitled "Shuttle".

A typical commercial dryer includes a tumbler cylinder mounted for rotation about a horizontal axis and which has an open side through which wet goods are inserted and dried goods are removed. The cylinder is housed within a shell and is rotated about the horizontal axis. The shell is pivoted at its bottom so that the shell can be tipped forward or rearward to permit dry linens to be expelled therefrom.

A particular disadvantage of prior art dryers is the fact that the dryer occupies a substantial quantity of floor space. Since the dryer shell is pivoted at its bottom, the dryer unloads either toward its front or toward its rear, which requires a considerable clearance in the unloading direction. Since such dryers are often used in a semi-automated line of equipment for washing and drying linens, a conveyor for the unloaded linens must be located to one side of the dryer at all times. Thus, access to the dryer at the unloading side is often difficult which makes periodic maintenance of the dryer more complicated.

U.S. Pat. Nos. 2,067,543 and 2,253,047 disclose dryers which are pivoted at the center of the tumbler shell. However, as shown in the two patents, even center pivoting of the shell requires that loading or unloading be to the front or rear of the dryer, thus required extra space to the front or rear of the dryer, as the case may be. A discharge conveyor would, similar to dryers having the shell pivoted at the bottom, necessarily be located in front of or behind the dryer, creating the same disadvantages as dryers which have a shell pivoted at the bottom.

SUMMARY OF THE INVENTION

The present invention overcomes the disadvantages of the prior art by providing a dryer which can unload directly beneath the dryer shell. Similar to conventional dryers, the present invention includes a tumbler cylinder mounted for rotation about a horizontal axis. The cylinder has an open side through which wet goods are inserted and dried goods are removed. The cylinder is housed in a shell and heated air is supplied to the cylinder for drying goods therein. The cylinder is rotated within the shell about the horizontal axis during the drying procedure.

In accordance with the invention, an external support is provided having a portion extending above the shell. Hinge means suspend the shell beneath the support portion for pivot about the hinge means. The hinge means is attached to the top of the shell and has a pivot axis perpendicular to the horizontal axis. The shell is pivoted about the hinge means to permit goods to be removed from the cylinder directly beneath the shell.

A door is provided for closing the open side of the cylinder and comprises a lower door segment which is fixedly secured to the external support, an upper door segment movably secured to the shell adjacent the open side of the cylinder, and means to shift the upper door segment from a first position closing an upper portion of the cylinder to a raised second position opening the upper portion. The lower door segment does not move and need not since it is attached to the support, not the cylinder.

The external support comprises a frame situated about the shell. The hinge means comprises a first bracket attached to the frame, a second bracket attached to the top of the shell adjacent the first bracket, and a hinge pin interconnecting the brackets. Preferably, a pair of the hinge means is provided on opposite sides of the shell.

An extensible fluid cylinder extending between the shell and the frame is used for pivoting the shell and tumbler cylinder. The fluid cylinder is activated to extend its ram in order to pivot the shell about the hinge means. A discharge conveyor is located directly beneath the shell to catch linens which are removed from the tumbler cylinder.

A close fit is provided between the door segments and the shell to prevent heated drying air from leaking from the interior of the shell. The lower door segment is attached to the support frame and is provided with a series of spaced horizontal arms which extend to a crossbeam secured to the support frame. Each arm includes a longitudinal slot adjacent the crossbeam and a bolt is provided passing through the slot into the crossbeam to permit fine adjustment of the lower door segment laterally toward and away from the shell.

The upper door is mounted in a guide which is attached to the front of the shell. The guide comprises a pair of spaced plates forming a pocket into which the upper door segment is shifted when the upper door segment is raised into the open position. In order to so shift the door, at least one extensible fluid cylinder is provided extending between the upper door segment and the shell.

An alignment stop for the shell is provided at the base thereof to both seat the shell when unpivoted, and assure that the shell is properly aligned adjacent the upper and lower door segments. The alignment stop comprises an inclined pad attached to the bottom of the shell and a corresponding inclined pad receptor attached to the support frame. The pad and the pad receptor are adjustable relative to one another so that the rest position of the shell can be closely controlled.

BRIEF DESCRIPTION OF THE DRAWINGS

The invention is described in greater detail in the following description of the example embodying the best mode of the invention, taken in conjunction with the drawings, in which.

DESCRIPTION OF THE EXAMPLE EMBODYING THE BEST MODE OF THE INVENTION

Figure 1:
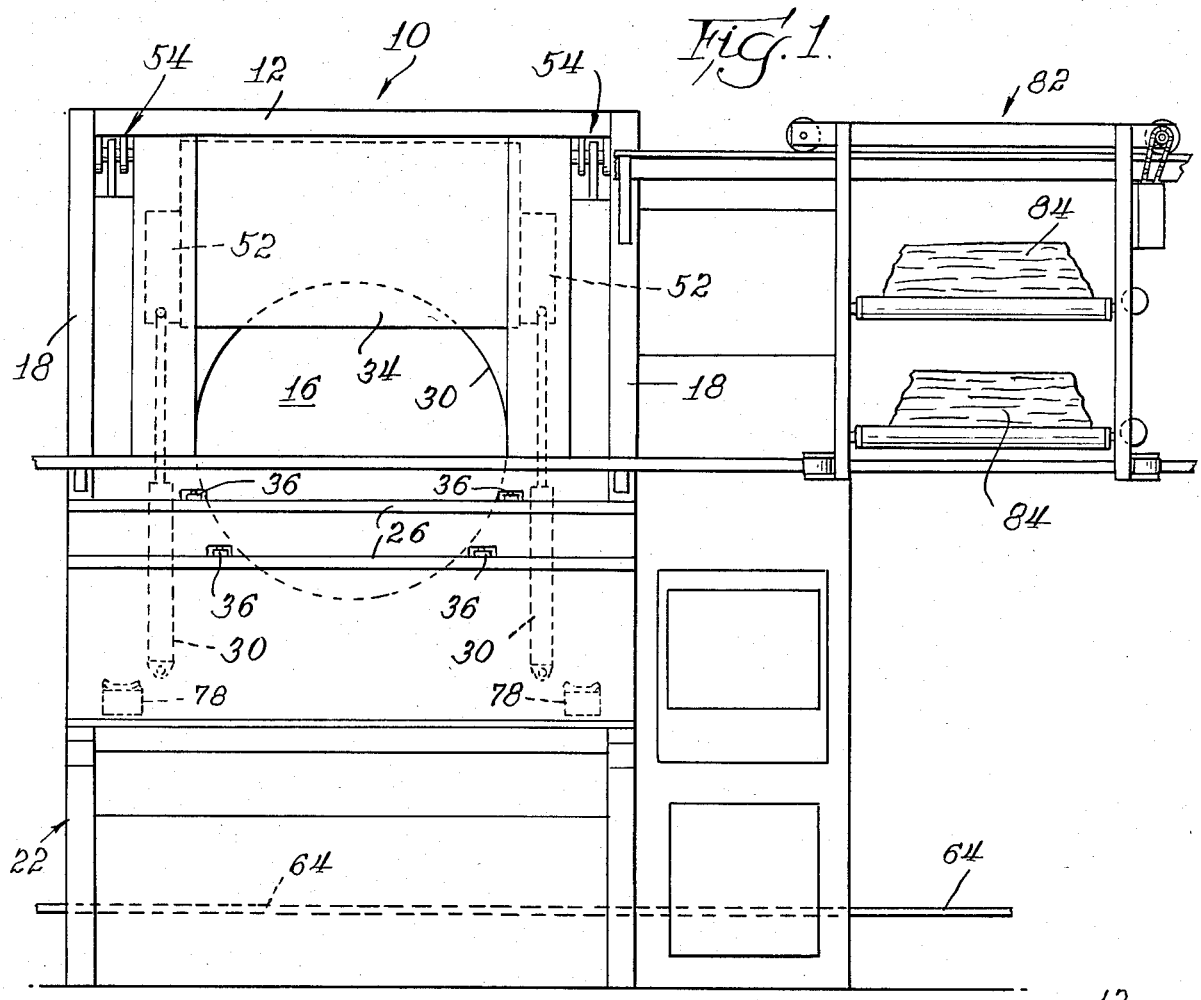
FIG. 1 is a front elevational illustration of the dryer according to the invention with the top door segment opened and showing a loading shuttle approaching the opened dryer.

The dryer of the invention is shown generally at 10 in the drawing figures. Primary components of the dryer are an external support 12, and a tumbler shell 14 which houses a tumbler cylinder 16.

Figure 2:
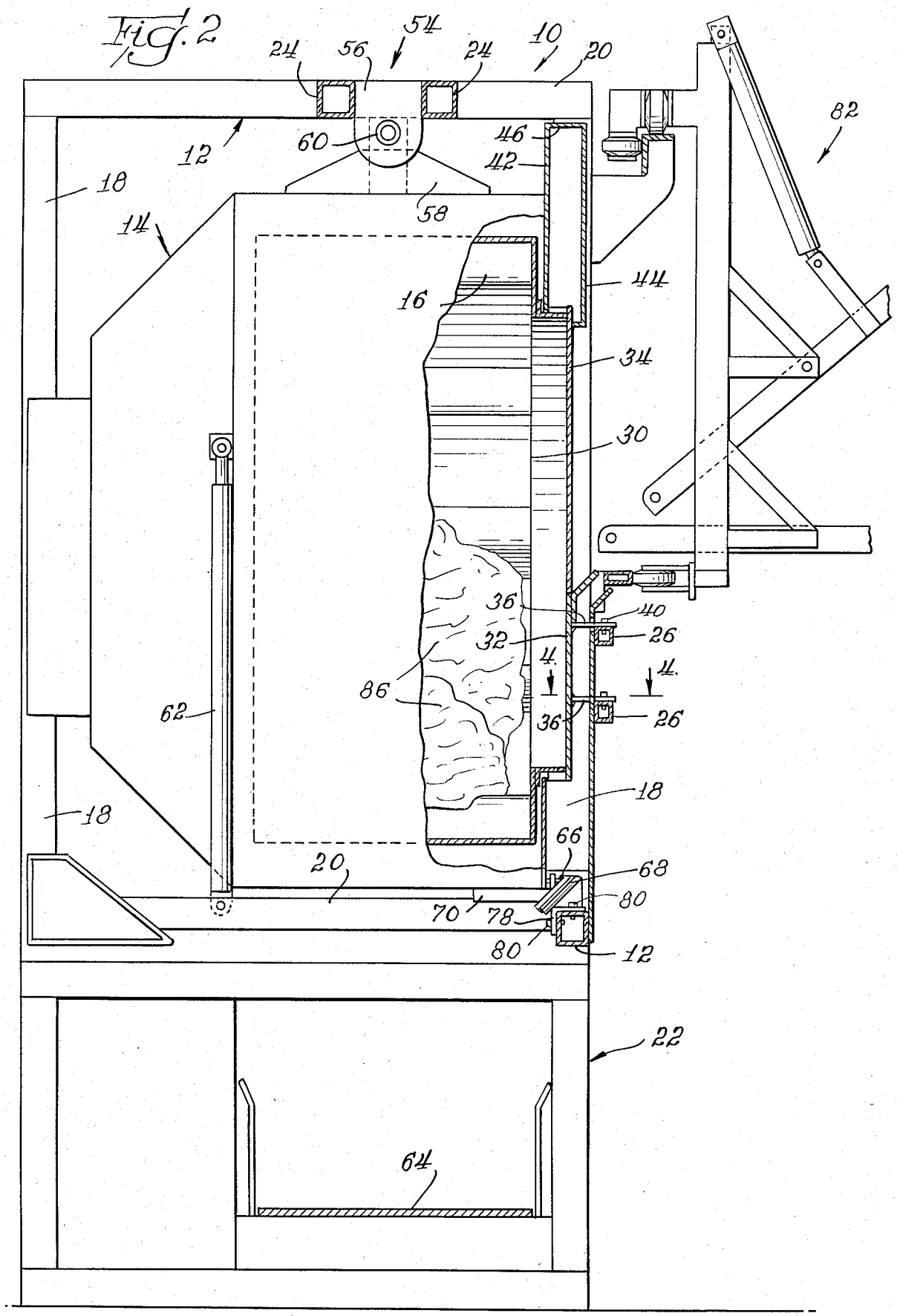
FIG. 2 is an enlarged side elevational illustration, partially in cross section, illustrating a loaded tumbler cylinder with the upper door segment shown just after the shuttle has finished loading the tumbler cylinder.
Figure 3:
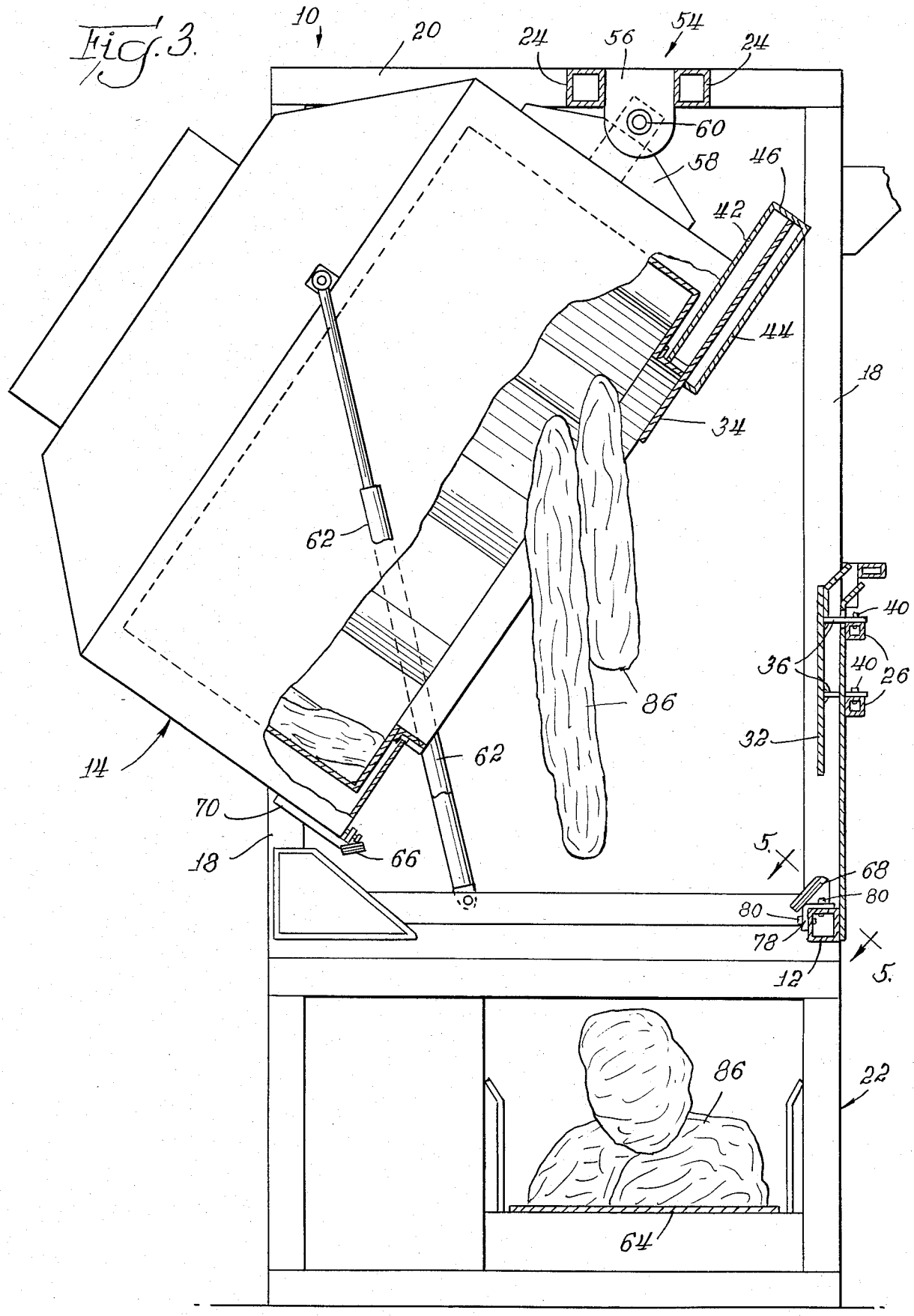
FIG. 3 is a side elevational illustration similar to FIG. 2 but showing the tumbler shell pivoted in a rearward direction so that the contents thereof are expelled into a conveyor located directly beneath the shell.

The external support 12 comprises a box-like framework composed of a series of vertical posts 18 interconnected by a horizontal cross members 20 at the top and bottom of the support 12. The entire support 12 sits upon a base 22 also composed of a series of vertical and horizontal framework members. The support 12 further includes a pair of spaced, parallel top beams 24 interconnecting the two top cross members 20 and a pair of crossbeams 26 extending between the two front posts 18 as shown in FIGS. 1 through 3.

As illustrated, the cylinder 16 is housed within the shell 14. The details of suspension of the cylinder 16 are not illustrated, as the cylinder 16 and shell 14 may be conventional. Common mounting for the cylinder 16 includes a trunnion at the rear thereof which extends into a motor housing in the rear of the shell 14 (left end in FIGS. 2 and 3). Heated air is introduced into the shell 14 through appropriate ducting from a tower 28 (FIG. 1) in which all heating and circulating elements are located. Since the same form no part of the invention, and can be constructed in accordance with well-known conventional means and apparatus, they are not shown in further detail.

One side 30 of the cylinder 16 (the right side in FIGS. 2 and 3) is opened. This permits introduction of goods to be dried and removal of the goods after they have been dried, as described in further detail below.

The open side 30 is closed by a door composed of a lower door segment 32 which is fixedly secured to the external support 12 and an upper door segment 34 which is movably secured to the shell 14 adjacent the open side 30. The door segments 32 and 34 cooperate to form a closed door when required (as shown in FIG. 2), and only the upper door segment 34 is permitted to move to open and close entry to the open side 30 of the cylinder 16 when the shell 14 is in the normal, vertically upright operating position (FIG. 2).

Figure 4:
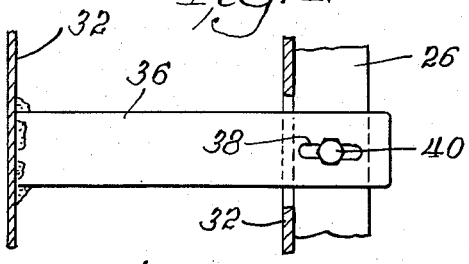
FIG. 4 is an enlarged cross-sectional illustration showing the adjustment means for the lower segment taken along lines 4—4 of FIG. 2.
Figure 5:
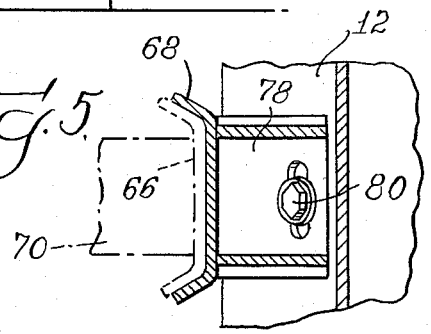
FIG. 5 is an enlarged cross-sectional illustration of the pad receptor of the alignment stop for the tumbler shell.
Figure 6:
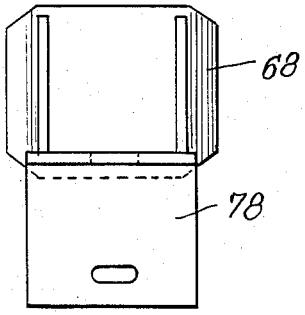
FIG. 6 is a rear view of the pad receptor of FIG. 5.
Figure 7:
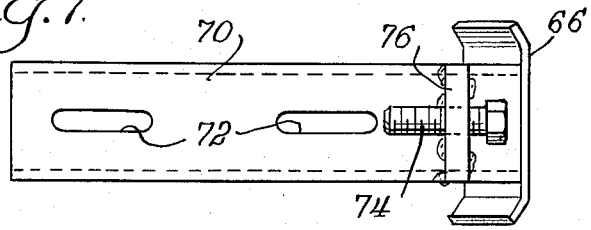
FIG. 7 is a top view of the pad of the alignment stop and its associated mounting hardware.
Figure 8:
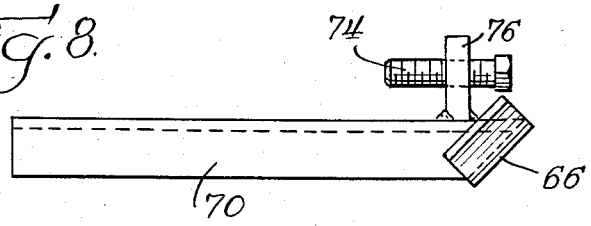
FIG. 8 is a side elevational illustration of the pad shown in FIG. 7.

As best shown in FIGS. 2 through 4, the lower door segment 32 is secured to the crossbeams 26 of the external support 12 by a plurality of spaced horizontal arms 36 which are welded to the lower door segment 32 and which extend contiguous to one of the two crossbeams 26. Each arm 36 has a longitudinal slot 38, and a bolt 40 passes through the slot 38 into the adjacent crossbeam 26. Thus, adjustment of the lower door segment 32 laterally toward and away from the shell 14 is permitted by loosening of the bolts 40 and repositioning of the lower door segment 32 before the bolts 40 are retightened.

The upper door segment 34 is disposed within a guide comprising a pair of spaced plates 42 and 44 forming a pocket into which the upper door segment 34 is partially retracted (FIGS. 1 and 3) for entry into the open side 30 of the cylinder 16. The plate 42 is securely attached to the shell 14 while the plate 44 is attached to the plate 42 by means of a top plate 46.

The position of the upper door segment 34 is controlled by a pair of opposed fluid cylinders 50 (FIG. 1) which are attached at one end to the shell 14 and at the other end to ears 52 extending laterally from the upper door segment 34. With the rams of the fluid cylinders 50 extended as shown in FIG. 1, the upper door segment 34 is raised into the pocket formed between the plates 42 and 44. With the rams of the fluid cylinders 50 retracted, the upper door segment 34 is lowered into the abutting relationship with the top of the lower door segment 32.

The shell 14 is suspended in the external support 12 by means of a pair of hinges 54 located at opposite sides of the shell 14 as shown in FIG. 1. Each hinge 54 comprises a bracket 56 attached between the parallel top beams 24, a bracket 58 attached to the top of the shell 14 adjacent to the bracket 56, and a hinge pin 60 interconnecting the two brackets 56 and 58. The shell 14 is pivoted about the hinges 54 by means of a pair of fluid cylinders 62 attached at one end to the lower cross members 20 and at their upper ends to the shell 14. As shown in FIG. 3, when the rams of the cylinders 62 are extended, the shell 14 is pivoted about the hinge 54 away from the fixed lower door segment 32. Thus, the contents of the shell 14 within the cylinder 16 are expelled directly beneath the shell 14 into an awaiting discharge conveyor 64 which transports the expelled linens or other contents of the cylinders 16 to a downstream location (not illustrated).

In order that the dryer 10 be as energy efficient as possible, it is important that, when it is operated, the shell 14 be closed by the door segments 32 and 34. Since the lower door of segment 32 is fixed in the frame of the external support 12, when the shell 14 is in the upright operational position (FIG. 2), the shell 14 and lower door segment 32 must be aligned as closely as possible. To aid in alignment, the dryer 10 is provided with a pair of alignment stops each comprising an inclined pad 66 which is secured to the base of the shell 14 and a corresponding inclined pad receptor 68 attached to the external support 12. As best shown in FIGS. 5 through 8, the inclined pad 66 is attached to an arm 70 having a pair of slots through which bolts (not illustrated) are passed to secure the arm 70 to the bottom of the shell 14. A bolt 74 passing through a vertical plate 76 secured to the top of the arm 70 is used to position the arm 70 and therefore the location of the inclined pad 66, as required.

The pad receptor 68 is shaped to engage and conform to the shape of the pad 66. The receptor 68 is welded to a bracket 78 and bolts 80 are used to attach the bracket 78 to the external support 12. While the brackets 78 may be adjusted laterally along the portion of the external support 12 to which they are attached, they cannot be adjusted toward or away from the shell.

As explained in detail in our above-identified copending application, a shuttle 82 may be used to deposit wet cakes 84 of linens into the cylinder 16 of the dryer 10.

Typical steps of operation of the dryer 10 are then as follows. When the shuttle 82 is aligned with the open side 30 of the cylinder 16, and with the upper door segment 34 in the raised position, the shuttle 82 expels the cakes 84 into the cylinder 16. The upper door segment 34 is then closed and the dryer 10 activated to dry the linens therein.

After the drying cycle, the upper door segment 34 is raised and the cylinders 62 are activated to pivot the shell 14 to the position shown in FIG. 3. Dried linens 86 fall by the force of gravity into the discharge conveyor 64 directly beneath the shell 14. As necessary, the cylinder 16 can be "jogged" (spun partial revolutions in either direction) to assure that all dried linens 86 leave the cylinder 16. Then, the fluid cylinder 62 is deactivated to return the shell 14 into the upright, operational position (FIG. 2). The dryer 10 is now available for delivery of another series of cakes 84 from the shuttle 82. The operational sequence just described is then repeated.

Various changes may be made to the invention without departing from the spirit thereof or scope of the following claims.

What is claimed is:

1. In a dryer for extracting moisture from wet goods, including a tumbler cylinder mounted for rotation about a horizontal axis, an open side of said cylinder through which wet goods are inserted and dry goods are removed, a shell in which the cylinder is housed, means for supplying heated air to the cylinder for drying goods therein, and means for rotating the cylinder within the shell about said horizontal axis, the improvement comprising a. a fixed external support having a portion extending above said shell, b. hinge means suspending said shell beneath said support portion for pivot about said hinge means, said hinge means having a first portion attached to said support and a second portion attached to the top of said shell and having a pivot axis perpendicular to said horizontal axis, c. means for pivoting said shell about said hinge means to permit goods to be removed from said cylinder directly beneath said shell, and d. a door for closing said open side, comprising i. a lower door segment fixedly secured to said external support, ii. an upper door segment moveably secured to said shell adjacent said open side, and iii. means to shift said upper door segment from a first position closing an upper portion of said open side to a second position opening said upper portion.

2. A dryer according to claim 1 in which said external support includes a frame about said shell.

3. A dryer according to claim 1 in which said first hinge means portion comprises a first bracket attached to said support portion, said second hinge means portion comprises a second bracket attached to the top of said shell adjacent said first bracket, and including a hinge pin interconnecting said brackets.

4. A dryer according to claim 1 in which said means for pivoting comprises an extensible fluid cylinder connected between said shell and said external support.

5. A dryer according to claim 1 including a discharge conveyor located beneath said shell.

6. A dryer according to claim 1 including means securing said lower door segment to said external support to permit said lower door segment to be adjusted laterally toward and away from said shell.

7. A dryer according to claim 6 in which said securing means comprises a plurality of spaced horizontal arms attached to said lower door segment, each said arm extending to a crossbeam secured to said external support and each said arm including a longitudinal slot adjacent said crossbeam, and including a bolt passing through said slot into said crossbeam.

8. A dryer according to claim 1 including a guide for said upper door segment attached to said shell.

9. A dryer according to claim 8 in which said guide comprises a pair of spaced plates forming a pocket into which said upper door segment is shifted to said second position.

10. A dryer according to claim 1 in which said shift means comprises at least one extensible fluid cylinder connected between said upper door segment and said shell.

11. A dryer according to claim 1 including an alignment stop for said shell.

12. A dryer according to claim 11 in which said alignment stop comprises an inclined pad attached to the bottom of said shell and a corresponding inclined pad receptor attached to said external support.

13. A dryer according to claim 12 in which said pad and said pad receptor are adjustable relative to one another.

14. A dryer according to claim 1 in which said door segments butt to close said door when said upper door segment is in said first position.

15. In a dryer for extracting moisture from wet goods, including a tumbler cylinder mounted for rotation about a horizontal axis, an open side of said cylinder through which wet goods are inserted and dry goods are removed, a shell in which the cylinder is housed, means for supplying heated air to the cylinder for drying goods therein, and means for rotating the cylinder within the shell about said horizontal axis, the improvement comprising a. an external support frame having a portion extending above said shell, b. a hinge suspending said shell beneath said support frame, said hinge including a first bracket attached to said frame portion, a second bracket attached to the top of said shell adjacent said first bracket, and a hinge pin interconnecting said brackets, c. an extensible fluid cylinder for pivoting said tumbler shell about said hinge to permit goods to be removed from said tumbler cylinder directly beneath said shell, said fluid cylinder being attached between said shell and said support frame, and d. a door for closing said open side, comprising i. a lower door segment secured to said support frame, ii. means to adjust said lower door segment laterally toward and away from said shell, iii. an upper door segment, iv. a guide for said upper door segment attached to said shell, and v. means to shift said upper door segment in said guide from a first position closing an upper portion of said open side to a second position opening said upper portion.

* * * * *